US007695382B2

(12) United States Patent
Morrow et al.

(10) Patent No.: US 7,695,382 B2
(45) **Date of Patent: *Apr. 13, 2010**

(54) REINFORCED LACROSSE HEAD

(75) Inventors: David Morrow, Metamora, MI (US); Jesse Hubbard, New York, NY (US); Andrew Maliszewski, Dearborn Heights, MI (US); Matthew Winningham, Royal Oak, MI (US)

(73) Assignee: Warrior Sports, Inc., Warren, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/832,753

(22) Filed: Aug. 2, 2007

(65) Prior Publication Data

US 2007/0270254 A1 Nov. 22, 2007

Related U.S. Application Data

(63) Continuation of application No. 10/437,842, filed on May 14, 2003, now Pat. No. 7,258,634.

(51) Int. Cl.
*A63B 59/02* (2006.01)
*A63B 65/12* (2006.01)

(52) U.S. Cl. ..... 473/513; D21/724; 473/505; 473/512

(58) Field of Classification Search ..... 473/513, 473/505; D21/724
See application file for complete search history.

(56) References Cited

U.S. PATENT DOCUMENTS 236,045 A * 12/1880 Kreutzer ..... 473/544
1,555,164 A 9/1925 Schwartz
1,611,858 A 12/1926 Middlekauff
1,750,644 A 3/1930 Norton
2,274,788 A * 3/1942 Hatton ..... 473/544
2,902,072 A 9/1959 Reuter
3,479,030 A 11/1969 Merola
3,701,374 A 10/1972 McGillvary
3,910,578 A * 10/1975 Brine, Jr. ..... 473/513
4,098,508 A * 7/1978 Gandy ..... 473/513
4,119,313 A 10/1978 Popplewell et al.

(Continued)

FOREIGN PATENT DOCUMENTS

GB 0424742 2/1935

(Continued)

OTHER PUBLICATIONS

Web Page Download, Devco Design and Development, 1998, http://www.devco-design.com/mi-mold.htm, 3 pp.

*Primary Examiner*—Gene Kim
*Assistant Examiner*—M Chambers
(74) *Attorney, Agent, or Firm*—Warner Norcross & Judd LLP

(57) ABSTRACT

A reinforced lacrosse head having improved strength includes a pair of opposing sidewall portions each having a top end and a bottom end, a scoop portion extending between the sidewall portions, a base portion extending between the bottom ends of the sidewall portions, and a throat portion extending from the base portion for attachment to a lacrosse handle. This reinforced lacrosse head has one or more reinforcement members that are coupled to one or more portions of the lacrosse head.

25 Claims, 2 Drawing Sheets

U.S. PATENT DOCUMENTS

| | | | | | |
|---|---|---|---|---|---|
| 4,683,784 | A | * | 8/1987 | Lamont | 81/22 |
| 5,054,790 | A | | 10/1991 | Brine et al. | |
| 5,470,649 | A | * | 11/1995 | Farley | 442/238 |
| 5,568,925 | A | | 10/1996 | Morrow et al. | |
| 5,651,549 | A | * | 7/1997 | Dill et al. | 473/513 |
| 5,685,791 | A | * | 11/1997 | Feeney | 473/513 |
| 6,066,056 | A | * | 5/2000 | Morrow | 473/513 |
| 6,213,901 | B1 | * | 4/2001 | Collinson | 473/513 |
| 6,676,547 | B1 | | 1/2004 | Morrow et al. | |
| 6,723,134 | B2 | | 4/2004 | Tucker | |
| 7,226,374 | B2 | * | 6/2007 | Morrow et al. | 473/513 |
| 7,258,634 | B2 | * | 8/2007 | Morrow et al. | 473/512 |

FOREIGN PATENT DOCUMENTS

| | | |
|---|---|---|
| JP | 2000-61005 | 2/2000 |

* cited by examiner

REINFORCED LACROSSE HEAD

CROSS-REFERENCE TO RELATED APPLICATIONS

This application is a continuation of U.S. application Ser. No. 10/437,842, entitled "Reinforced Lacrosse Head" and filed on May 14, 2003, which claims priority from U.S. Provisional Application Ser. No. 60/380,547, entitled "Stiffening Ribs For A Lacrosse Head," and filed on May 14, 2002, the disclosures of which are incorporated by reference herein.

TECHNICAL FIELD

The present invention relates generally to a lacrosse head for attachment to a lacrosse stick, and more particularly to a lacrosse head having increased strength without increasing the weight of the lacrosse head.

BACKGROUND OF THE INVENTION

Lacrosse heads for use in the game of lacrosse are well known. Current lacrosse heads typically are manufactured by plastic injection molding processes and are secured to a lacrosse handle or stick for use in play. The structure of a typical lacrosse head is defined by a throat portion for connection to the lacrosse handle, a base portion that is disposed adjacent to the throat portion and defines a ball rest, a pair of opposing sidewall portions that generally diverge from the base portion, and a scoop portion that connects the ends of the opposing sidewall portions opposite the base portion. Furthermore, these lacrosse heads typically have netting attached to a back side of each of the base portion, the sidewall portions, and the scoop portion. This netting ordinarily is utilized for retaining a lacrosse ball within the lacrosse head.

The sidewall portions of current lacrosse heads typically have an open sidewall construction that is comprised of a plurality of non-string hole openings formed in the sidewalls. This open-frame construction can decrease the amount of material utilized to form the sidewall portions and thus the head, thereby decreasing the overall manufacturing and material costs for the entire lacrosse head. A drawback of the open-frame construction is that it can create structural weaknesses within the lacrosse head and allow the lacrosse head to twist, bend, otherwise deform, or even break. From this point, it will be appreciated that the less material utilized to form the lacrosse head, the weaker the lacrosse head structure can become.

One proposed solution for these structural weaknesses relates to the provision of stiffening ribs that are integrally formed in the head and extend from the socket or the base portion toward the scoop. The stiffening ribs are typically located above and below the sidewall openings to provide structural support thereto. These stiffening ribs usually are thicker than the main portion of the sidewalls to increase the structural integrity thereof. The lacrosse head is preferably constructed of a plastic material and the stiffening ribs are integrally molded as part of the lacrosse head during the same molding process. Unfortunately, however, these stiffening ribs may not be sufficiently strong for preventing the deformation or the breakage of the lacrosse head. Alternatively, they can add too much material and thus weight to the lacrosse head, thereby yielding an undesirable lacrosse head.

Therefore, a need exists for a reinforced lacrosse head that has improved strength, enhanced stiffness, and relatively low manufacturing costs.

SUMMARY OF THE INVENTION

One advantage of the present invention is to provide a reinforced lacrosse head that has increased strength and resistance to deformation or breakage.

Another advantage of the present invention is to provide a reinforced lacrosse head that has increased strength and is still substantially lightweight as compared to current lacrosse heads, which yields decreased material and manufacturing costs.

Yet another advantage of the present invention is to provide a reinforced lacrosse head that requires less plastic, thereby decreasing the amount of time required for cooling the plastic and consequently decreasing the overall manufacturing cycle time of the lacrosse head.

In accordance with the above and the other advantages of the present invention, the present invention provides a reinforced lacrosse head having a substantially strong construction for resisting deformation or breakage. The reinforced lacrosse head includes a pair of opposing sidewall portions each having a top end and a bottom end, a scoop portion extending between the sidewall portions, a base portion extending between the bottom ends of the sidewall portions, and a throat portion extending from the base portion for attachment to a lacrosse handle. In one embodiment, the sidewall portions have an open sidewall construction in that each sidewall portion is comprised of one or more non-string hole openings formed therein. Each sidewall portion includes one or more stiffening ribs integrated therein for reinforcing the sidewalls adjacent the openings in the sidewalls. Furthermore, the reinforced lacrosse head includes one or more reinforcement members that are insert-molded within the stiffening ribs. In an alternate embodiment, one or more reinforcement members can be insert molded into the scoop portion, the base portion, and/or the throat portion.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Figure 1:
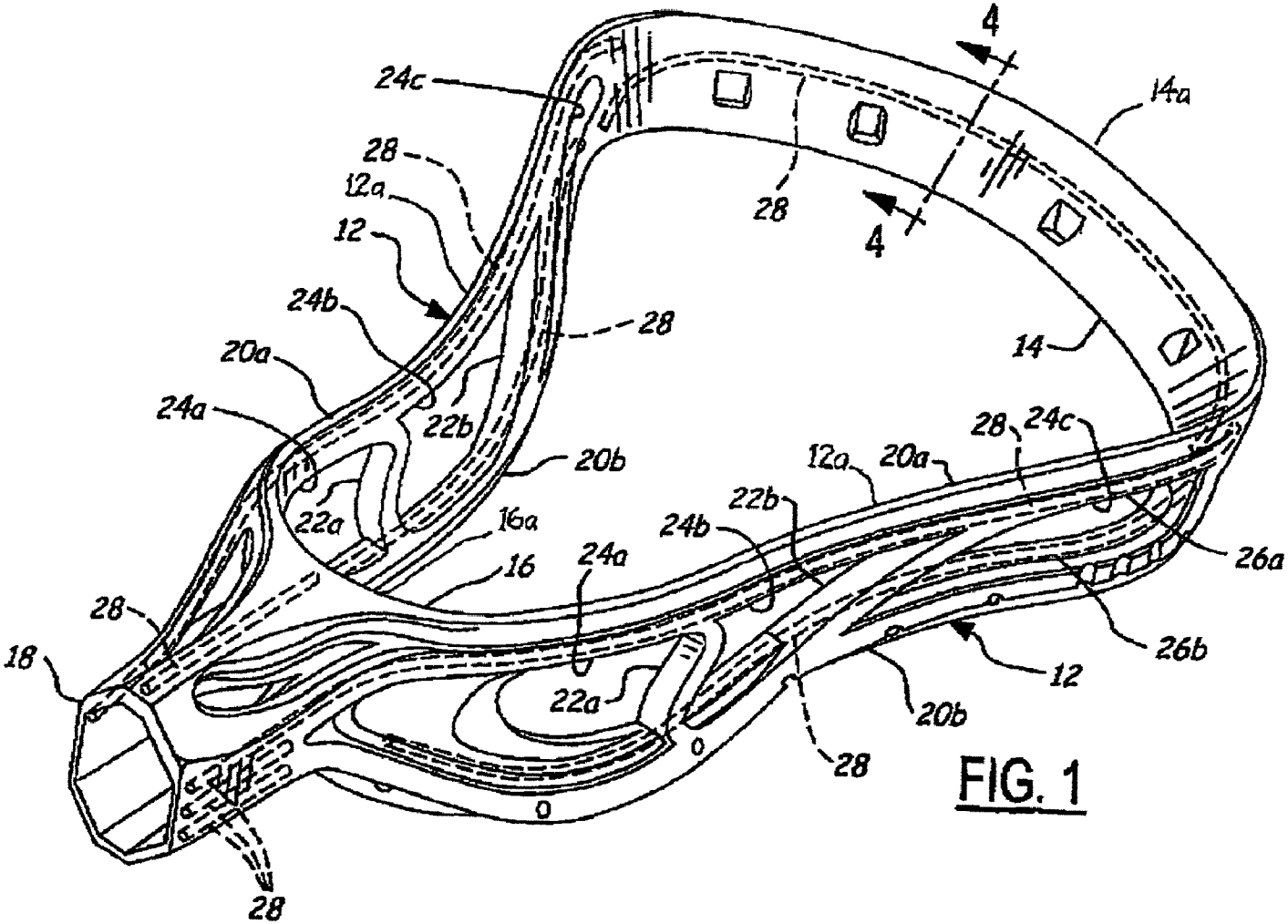
FIG. 1 is a perspective view of a reinforced lacrosse head having a series of reinforcement members insert-molded therein, according to one embodiment of the present invention.

In the following figures, the same reference numerals are used to identify the same components in the various views.

The present invention is particularly suited to a lacrosse head having sidewall portions with an open-frame construction and with one or more reinforcement members insert-molded therein. For this reason, the embodiments described herein utilize features where the context permits. However, various other embodiments without the described features are contemplated as well. In other words, the present invention can be carried out in various other modes as desired. Moreover, the present invention can be utilized with a variety of differently configured lacrosse heads, including non-open sidewall lacrosse heads and straight-walled lacrosse heads.

Figure 2:
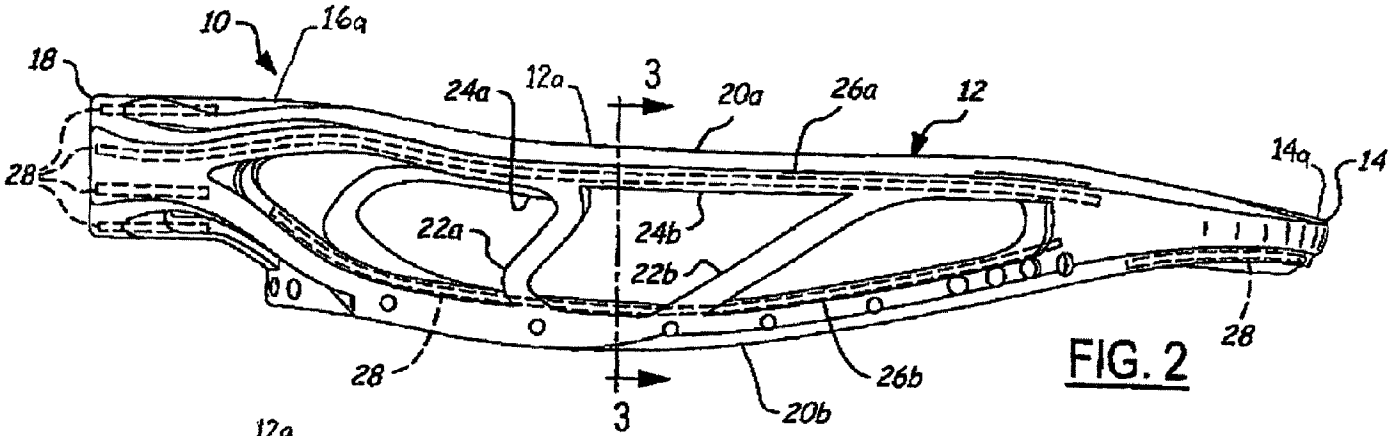
FIG. 2 is a side view of the reinforced lacrosse head shown in FIG. 1.

Referring to FIGS. 1 and 2, there is shown a reinforced lacrosse head 10 according to one embodiment of the present invention. The reinforced lacrosse head 10 is preferably a one-piece injection-molded frame element including a pair of opposing sidewall portions 12 each having a top end and a bottom end, a scoop portion 14 extending between and connecting the top ends of the sidewall portions 12, a base portion 16 extending between and connecting the bottom ends of the sidewall portions 12, and a throat portion 18 extending from the base portion 16 for attachment to a lacrosse handle. As shown in FIG. 1, the sidewall portions 12, the scoop portion 14, and the base portion 16 have respective front edge portions 12*a*, 14*a*, 16*a* for defining a ball-receiving area. In one embodiment, the lacrosse head 10 is formed from conventional plastic injection molding techniques. However, in another embodiment, the lacrosse head 10 is formed from a gas-assist injection molding process. In yet another embodiment, the lacrosse head 10 is formed from structural foam molding techniques.

The sidewall portions 12 have an open-frame construction in that each sidewall portion 12 is comprised of two or more rail portions 20*a*, 20*b* with one or more cross members 22*a*, 22*b* in connection therebetween. In this embodiment, the rail portions 20*a*, 20*b* and the cross members 22*a*, 22*b* define three openings 24*a*, 24*b*, 24*c* in the sidewall portion 12. This open-frame construction substantially decreases the amount of material utilized to form the sidewall portions 12 and thus the head, thereby decreasing the overall weight of the lacrosse head 10. In addition to the construction exemplified in FIGS. 1 and 2, it is understood that the lacrosse head 10 can instead have more or less than two rail portions 20*a*, 20*b*, more or less than two cross members 22*a*, 22*b*, and more or less than three openings 24*a*, 24*b*, 24*c* as desired. It is well known in the art to vary the design and configuration of the sidewall portions.

Figure 3:
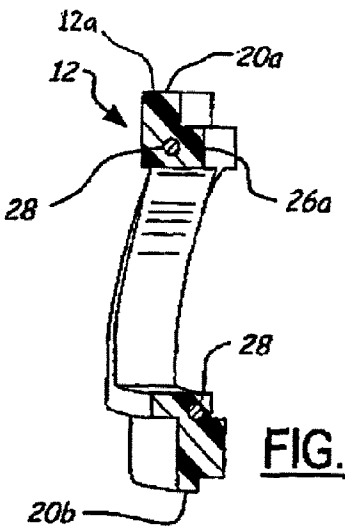
FIG. 3 is a cross-sectional view of a sidewall portion of the reinforced lacrosse head shown in FIG. 2, as taken along line 3-3.

As best shown in FIG. 3, each rail portion 20*a*, 20*b* has at least one stiffening rib 26*a*, 26*b* formed thereon for strengthening the respective rail portion 20*a*, 20*b* as well as the sidewall. Specifically, in one embodiment, each stiffening rib 26*a*, 26*b* is a thicker integral part of its respective rail portion 20*a*, 20*b* and extends the length of the rail portion 20*a*, 20*b* from the base portion 16 to the scoop portion 14. Moreover, each stiffening rib 26*a*, 26*b* extends into communication with the throat portion 18 to provide additional structural integrity thereto. Additionally, the stiffening ribs 26*a*, 26*b* are preferably located in the sidewall portions 12 above and below the openings 24*a*, 24*b*, 24*c* to provide structural support thereto. However, it will be understood that the stiffening ribs can be located in a variety of different locations on the lacrosse head. The term stiffening ribs encompass areas of the sidewall that are thicker than the surrounding portions of the sidewall.

Referring generally to FIGS. 1-4, the reinforced lacrosse head 10 generally has one or more reinforcement members 28 insert-molded therein or otherwise coupled thereto for strengthening the lacrosse head 10. As shown in FIGS. 1-4, the reinforcement members 28 are disposed sufficiently distal to the front edges 12*a*, 14*a*, 16*a* so as to form those front edges 12*a*, 14*a*, 16*a* with sufficient plastic material for resisting breakage upon the impact of a ball thereon. In this regard, the reinforcement members 28 are housed within relatively thick and therefore sufficiently strong plastic material. Moreover, one skilled in the art will appreciate the front edges 12*a*, 14*a*, 16*a* locally deform a predetermined amount so as to absorb a portion of the ball's kinetic energy. In that way, the front edges 12*a*, 14*a*, 16*a* decrease the speed of a ball and improve the player's ability to retrieve or catch the ball. Further, the reinforcement members 28 provide a generally rigid and relatively non-deformable overall construction In one embodiment, each reinforcement member 28 is a wire cylinder or tube comprised of a strong lightweight metal, e.g. aluminum or titanium. However, it will be appreciated that the reinforcement member can instead be comprised of other suitable strong lightweight materials, e.g. graphite. In addition, it is also understood that the reinforcement member 28 can have various other constructions instead of a wire construction. For example, the reinforcement member 28 can have an elongated plate construction that is contoured for inclusion within a particular portion of the lacrosse head.

With particular attention to the embodiment shown in FIG. 3, the reinforcement members 28 are insert-molded within the stiffening ribs 26*a*, 26*b* of the rail portions 20*a*, 20*b* and extend substantially within the rib portions along the length of rib portions 26*a*, 26*b*. Furthermore, as illustrated best in FIGS. 2 and 4, it will be appreciated that the reinforcement members 28 can be integrated within the scoop portion 14, the base portion 16, the throat portion 18, or any combination of those portions as desired. It is also contemplated that a single reinforcement member 28 can be integrated within and extend across more than one portion of the lacrosse head. For example, a wire having the general shape of the lacrosse head frame can be integrated within the scoop portion, the sidewall portions, and the base portion.

Figure 4:
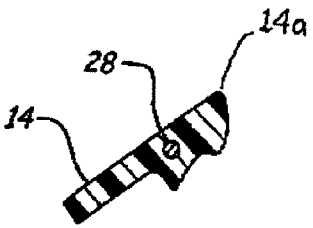
FIG. 4 is a cross-sectional view of a scoop portion of the reinforced lacrosse head shown in FIG. 1, as taken along line 4-4.

Referring now to FIGS. 3 and 4, it can be seen that the reinforcement member 28 has a diameter suitable for inclusion within the structure of a particular portion of the lacrosse head, namely the rail portions 20*a*, 20*b* and/or the scoop portion 14. However, it will be appreciated that the reinforcement member 28 can instead be attached to the surface of the lacrosse head as desired.

Furthermore, although the Figures show only one reinforcement member embedded within a particular portion of the lacrosse head, it is understood that more than one reinforcement member can be embedded within the same portion. For example, a bundle of wires having sufficiently small diameters can be insert-molded within the same rail portion, either side by side or end to end. In this embodiment, the head is a solid structure with inserts or reinforcement members molded therein.

In an alternative embodiment, the lacrosse head 10 is formed by a gas-assist injection molding process. By this process, the reinforcement member 28 is located, at least in part, in a cavity to be formed in the head 10 during the formation of the head. The reinforcement member 28 will obviously be maintained in place by the plastic. The reinforcement member 28 can instead be located adjacent the cavity. Further, it will be understood that the reinforcement member 28 can be sized smaller than the cavity in length and/or width and that multiple reinforcement members 28 can be located in each cavity. Again, the reinforcement members can be located end to end or side by side. The gas-assist injection molding process forms a lacrosse head with decreased weight because less material is required to form the head. Further, the head is stronger adjacent the cavity as will be understood by one of skill in the art. It will be understood that in yet another embodiment, the lacrosse head 10 can be formed by structural foam molding processes. In this alternative embodiment, the lacrosse head is formed of a plastic material with cavities or voids formed therein. Further, the head includes reinforcement members 28 molded therein, either in the cavities or in other portions of the head.

The first step in the forming of a lacrosse head is to determine its shape and configuration. Once the configuration is selected, a mold having a mold cavity can be formed in the shape of the head to be formed. If a gas-assist injection molding process is to be utilized, then it must also be determined where the cavities in the head will be located. Thereafter, the mold will have to be configured to allow the gas to form the cavities in those selected locations, such as the structural ribs, the scoop, the base and/or socket. Thereafter, the reinforcement members 28 can be located in the mold such that they will be molded in the head in locations where strength or reinforcement is desired. By combining gas-assist injection molding or structural foam molding with the utilization of reinforcement members, the strength of the head can be increased without increasing the weight of the lacrosse head 10.

While particular embodiments of the invention have been shown and described, numerous variations and alternate embodiments will occur to those skilled in the art. Accordingly, it is intended that the invention be limited only in terms of the appended claims.

What is claimed is:

1. A lacrosse head formed of a plastic material said lacrosse head intended for attachment to a lacrosse handle to form a lacrosse stick, comprising:

an open frame having a catching side into which a lacrosse ball enters and exits the head and a pocket side which opposes said catching side, said open frame including:

a pair of opposing sidewall portions each having a top end and a bottom end, at least one of the sidewalls defining a non-string aperture adapted to reduce the weight of the open frame;

a ballstop portion extending generally between said bottom ends of said pair of opposing sidewall portions;

a scoop portion extending generally between said top ends of said pair of opposing sidewall portions;

a throat portion extending rearwardly from said ballstop portion to facilitate formation of the lacrosse stick;

a plurality of attachment structures formed adjacent said pocket side of the head to facilitate attachment of a netting to the head; and at least one reinforcement member encapsulated within the plastic material of the lacrosse head, wherein said at least one reinforcement member is formed from a first material and the lacrosse head is formed from a second material different from the first material, said at least one reinforcement member having greater strength than the plastic material, wherein said at least one reinforcement member is selectively positioned in said scoop portion and terminates short of said top ends of said pair of opposing sidewall portions;

said at least one reinforcement member being sufficiently sized for strengthening said portion of the plastic material;

wherein said scoop portion has a first cross-sectional shape and the reinforcement member has a second cross-sectional shape, wherein the first cross-sectional shape is different from the second cross-sectional shape;

wherein said at least one reinforcement member has an outer peripheral shape and wherein substantially all of said at least one reinforcement member is buried substantially within said scoop portion so that said outer peripheral shape of said at least one reinforcement member is not reflected through the plastic material forming said scoop portion;

wherein the lacrosse head has at least one of a front edge and a back edge defining a ball receiving area and an area for net attachment, respectively;

wherein said at least one reinforcement member is disposed distal from said at least one of the front edge and the back edge to reduce the likelihood of breakage of the plastic material proximal said at least one reinforcement member.

2. The lacrosse head of claim 1, wherein said at least one reinforcement member is formed from at least one of a composite material and metal.

3. The lacrosse head of claim 1, comprising at least one reinforcement member placed within said sidewall portions.

4. The lacrosse head of claim 1, comprising at least one reinforcement member placed within said throat portion.

5. The lacrosse head of claim 1, wherein said at least one reinforcement member is a cylindrical wire.

6. A reinforced lacrosse head comprising:

an open frame having an upper portion generally defining a ball receiving area and a lower portion generally defining a ball retention area, said ball receiving portion being the portion of the head where a lacrosse ball enters and exits and said ball retention portion being the area were a netting is attached to the head, said open frame including:

a pair of opposing open sidewall portions each having a top end and a bottom end with each of said sidewall portions having at least one non-string hole opening formed therein;

a ballstop portion extending generally between said bottom ends of said pair of opposing open sidewall portions;

a scoop portion extending generally between said top ends of said pair of opposing open sidewall portions;

a throat portion extending from said ballstop portion to facilitate formation of the lacrosse stick;

at least one stiffening rib integrally formed within each of said pair of opposing sidewall portions;

a plurality of string attachment structures formed in said open frame to facilitate attachment of a netting thereto; and at least one reinforcement member selectively encapsulated in said sidewall portions, wherein said at least one reinforcement member terminates short of said scoop portion and short of said throat portion;

said reinforcement member being sufficiently sized for strengthening said sidewall portions;

wherein said at least one reinforcement member is formed from a first material and the lacrosse head is formed from a second material different from the first material;

wherein the sidewall portions have at least one first cross-sectional shape and the reinforcement member has a second cross-sectional shape, wherein said at least one first cross-sectional shape is different from said second cross-sectional shape;

wherein the second cross-sectional shape of the reinforcement member is not reflected through the sidewall portions;

wherein the lacrosse head has at least one of a front edge and a back edge defining a ball receiving area and an area for net attachment, respectively;

wherein said at least one reinforcement member is disposed distal from said at least one of the front edge and the back edge to reduce the likelihood of breakage of the plastic material proximal said at least one reinforcement member.

7. The reinforced lacrosse head of claim 6, wherein said at least one reinforcement member is insert-molded within said at least one stiffening rib.

8. The reinforced lacrosse head of claim 6, wherein said second cross-sectional shape is selected from the group consisting of a circle, an ellipse, a regular polygon, and an irregular polygon.

9. The lacrosse head of claim 6, wherein the at least one reinforcement member is formed as a cylindrical wire.

10. The lacrosse head of claim 6, wherein the lacrosse head and the lacrosse handle are separate components that are mechanically secured to form the lacrosse stick, wherein the reinforcement member extends toward the lacrosse handle without extending into the lacrosse handle.

11. The lacrosse head of claim 6, wherein the reinforcement member is constructed from at least one of a composite material and metal.

12. A lacrosse head portion of a lacrosse stick, the lacrosse head being constructed primarily of a plastic material, comprising:

a pair of opposing open sidewall portions each having a top end and a bottom end, each of said pair of opposing open sidewall portions further including an upper rail and a lower rail each extending between said top end and said bottom end;

at least one cross member extending between and connecting said at least two rail portions;

a ballstop portion extending generally between said bottom ends of said pair of opposing open sidewall portions;

a scoop portion extending generally between said top ends of said pair of opposing open sidewall portions;

a throat portion extending from said ballstop portion to facilitate formation of the lacrosse stick;

at least one reinforcement member selectively encapsulated within the head in at least one of said upper rails, wherein said at least one reinforcement member is formed from a first material and the lacrosse head is formed from a second material different from the first material, wherein said at least one reinforcement member terminates short of said scoop portion and short of said throat portion;

said at least one reinforcement member being sufficiently sized for strengthening at least one of said upper rails;

wherein said at least one reinforcement member is disposed within a sufficiently thick portion of at least one of said upper rails to strengthen the plastic material proximal said at least one reinforcement member;

wherein said at least one reinforcement member has an outer peripheral shape and wherein substantially all of said at least one reinforcement member is buried substantially within at least one of said upper rails so that said outer peripheral shape of said at least one reinforcement member is not reflected through the plastic material forming said at least one upper rail;

wherein said upper rails have a first cross-sectional shape and wherein said at least one reinforcement member has a second cross-sectional shape, wherein the first cross-sectional shape is different from the second cross-sectional shape;

wherein the lacrosse head has at least one of a front edge and a back edge defining a ball receiving area and an area for net attachment, respectively;

wherein said at least one reinforcement member is disposed distal from said at least one of the front edge and the back edge to reduce the likelihood of breakage of the plastic material proximal said at least one reinforcement member.

13. The lacrosse head of claim 12, wherein said second cross-sectional shape is selected from the group consisting of a circle, an ellipse, a regular polygon, and an irregular polygon.

14. The lacrosse head of claim 12, wherein the at least one reinforcement member is constructed from metal.

15. A plastic lacrosse head comprising:

an open frame portion having a front side for receiving a lacrosse ball and a back side for retaining said lacrosse ball when it is held in the head, said open frame having a plurality of net attachment structures to allow a netting to be secured to said open frame;

a pair of opposing sidewall portions each having a first end, a second end, an upper rail, and a lower rail, said lower rails having a first cross-sectional shape;

a ballstop portion extending generally between said first ends of said pair of opposing sidewall portions;

a scoop portion extending between said second ends of said pair of opposing sidewall portion;

a throat portion extending rearwardly from said ballstop portion from which a lacrosse handle extends;

at least one opening formed in each of said sidewall portions that is not intended to serve as a net attachment structure;

at least one reinforcement member being selectively encapsulated within the plastic lacrosse head in at least one of said lower rails, wherein said at least one reinforcement member is formed from a first material and the lacrosse head is formed from a second material different from the first material, wherein said at least one reinforcement member terminates short of said scoop portion and short of said throat portion;

said at least one reinforcement member having a second cross-sectional shape and being sufficiently sized for strengthening the head and decreasing undue flexibility during play;

wherein substantially all of said at least one reinforcement member is buried substantially within at least one of said lower rails so that said second cross-sectional shape is not reflected through the plastic material of said at least one lower rail;

wherein the first cross-sectional shape is different from the second cross-sectional shape;

wherein the lacrosse head has at least one of a front edge and a back edge defining a ball receiving area and an area for net attachment, respectively;

wherein said at least one reinforcement member is disposed distal from said at least one of the front edge and the back edge to reduce the likelihood of breakage of the plastic material proximal said at least one reinforcement member.

16. The lacrosse head of claim 15, wherein at least one reinforcement member is constructed from metal.

17. The lacrosse head of claim 15, wherein the lacrosse head and the lacrosse handle are separate components that are mechanically secured to form the lacrosse sticks.

18. A lacrosse head formed of a plastic material, comprising:

a pair of opposing sidewall portions each having a top end and a bottom end;

a ballstop portion extending between said bottom ends of said pair of opposing sidewall portions;

a scoop portion extending between said top ends of said pair of opposing sidewall portions;

a throat portion extending from said ballstop portion for engagement with a lacrosse handle; and a plurality of solid reinforcement members selectively encapsulated within the plastic material of predetermined portions of the lacrosse head, said predetermined portions having at least one first cross-sectional shape;

wherein the plurality of reinforcement members are constructed of a material that is different from and stronger than said plastic material, each of said plurality of reinforcement members being sufficiently sized for strengthening the plastic material proximal said plurality of reinforcement members;

wherein the lacrosse head has at least one of a front edge for defining a ball-receiving area and a back edge for attachment of a net;

wherein said plurality of reinforcement members are disposed distal from said at least one of the front edge and the back edge to reduce the likelihood of breakage of the plastic material proximal said at least one reinforcement member;

wherein said plurality of reinforcement members have a second cross-sectional shape, wherein the first cross-sectional shape is different from the second cross-sectional shape;

wherein said second cross-sectional shape is not reflected though the plastic material of the lacrosse head;

wherein said reinforcement members terminate short of the lacrosse handle.

19. The lacrosse head of claim 18 wherein said predetermined portions of the lacrosse head include at least one of said sidewall portions, said ballstop portion, said scoop portion and said throat portion.

20. The lacrosse head of claim 19 wherein said plurality of reinforcement members are formed from at least one of metal and a composite material.

21. The lacrosse head of claim 19 wherein said predetermined portions of the lacrosse head are located in said scoop portion.

22. A lacrosse head portion of a lacrosse stick, the lacrosse head being constructed primarily of a plastic material, comprising:

a pair of opposing open sidewall portions each having a top end and a bottom end, each of said pair of opposing open sidewall portions further including an upper rail and a lower rail each extending between said top end and said bottom end, said upper rail being of a first cross-sectional shape and said lower rail being of a second cross-sectional shape;

at least one cross member extending between and connecting said at least two rails;

a ballstop portion extending generally between said bottom ends of said pair of opposing open sidewall portions;

a scoop portion extending generally between said top ends of said pair of opposing open sidewall portions;

a throat portion extending from said ballstop portion, the throat portion adapted to join with a separate lacrosse handle to form the lacrosse stick;

a reinforcement member encapsulated within at least one of said upper rail and said lower rail, wherein said reinforcement member is formed from a first material and the lacrosse head is formed from a second material different from the first material, wherein said reinforcement member does not extend into said lacrosse handle;

wherein said reinforcement member is sufficiently sized for strengthening said sidewall portions;

wherein said reinforcement member is encapsulated within a sufficiently thick portion of at least one of said upper and lower rails to strengthen the plastic material proximal said reinforcement member;

wherein said reinforcement member has a third cross-sectional shape and wherein substantially all of said reinforcement member is buried substantially within at least one of said upper rail and said lower rail so that said third cross-sectional shape is not reflected through said at least one of said upper rail and said lower rail;

wherein the third cross-sectional shape is different from the first cross-sectional shape and different from the second cross-sectional shape;

wherein the lacrosse head has at least one of a front edge and a back edge defining a ball receiving area and an area for net attachment, respectively;

wherein said reinforcement member is disposed distal from said at least one of the front edge and the back edge to reduce the likelihood of breakage of the plastic material proximal said reinforcement member.

23. The lacrosse head of claim 21 further comprising at least one stiffening rib integrally formed within each of said pair of opposing sidewall portions, wherein said reinforcement member is positioned in said stiffening rib.

24. The lacrosse head of claim 22 wherein said reinforcement member is formed from at least one of a composite material and metal.

25. The lacrosse head of claim 22 wherein said reinforcement member includes an outer surface and a periphery, said outer surface being joined directly and continuously with the plastic material around its entire periphery along a substantial portion of the reinforcement member.

* * * * *

UNITED STATES PATENT AND TRADEMARK OFFICE

CERTIFICATE OF CORRECTION

PATENT NO. : 7,695,382 B2
APPLICATION NO. : 11/832753
DATED : April 13, 2010
INVENTOR(S) : David Morrow et al.

It is certified that error appears in the above-identified patent and that said Letters Patent is hereby corrected as shown below:

Related U.S. Application Data

"(63) Continuation of application No. 10/437,842, filed on May 14, 2003, now Pat. No. 7,258,634"

should be

--(63) Continuation of application No. 10/437,842, filed on May 14, 2003, now Pat. No. 7,258,634

(60) Provisional application No. 60/380,547, filed May 14, 2002--

Signed and Sealed this

Tenth Day of August, 2010

David J. Kappos

David J. Kappos
*Director of the United States Patent and Trademark Office*